US006651388B1

(12) United States Patent
Scheck

(10) Patent No.: US 6,651,388 B1
(45) Date of Patent: Nov. 25, 2003

(54) FOLLOWER USING PIVOTING RETAINING ARMS FOR RETAINING A WINDOW PANE

(75) Inventor: Georg Scheck, Weitramsdorf (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 09/763,928

(22) PCT Filed: Aug. 13, 1999

(86) PCT No.: PCT/DE99/02555

§ 371 (c)(1),
(2), (4) Date: Feb. 26, 2001

(87) PCT Pub. No.: WO00/12855

PCT Pub. Date: Mar. 9, 2000

(30) Foreign Application Priority Data

Aug. 26, 1998 (DE) ..... 198 40 682

(51) Int. Cl.[7] ..... E05F 11/38
(52) U.S. Cl. ..... 49/375; 49/372
(58) Field of Search ..... 49/372, 374, 375, 49/376, 377, 378, 502

(56) References Cited

U.S. PATENT DOCUMENTS 4,530,186 A * 7/1985 Guillon ..... 49/411
4,776,132 A * 10/1988 Gold ..... 49/375
4,827,669 A * 5/1989 Hlavaty et al. ..... 49/436
4,949,509 A * 8/1990 Gold ..... 49/502
5,069,010 A * 12/1991 Trainor et al. ..... 52/127.8
5,199,217 A 4/1993 Roze
5,692,273 A 12/1997 Rodde
5,791,088 A * 8/1998 Martinelli et al. ..... 49/375
5,992,099 A 11/1999 Thomas

FOREIGN PATENT DOCUMENTS

| | | | |
|---|---|---|---|
| DE | 44 34 589 | | 4/1996 |
| EP | 0 294 254 | | 12/1988 |
| EP | 0 643 188 | | 3/1995 |
| EP | 0 694 669 | | 1/1996 |
| EP | WO 96/26080 | * | 8/1996 |

* cited by examiner

*Primary Examiner*—Gregory J. Strimbu
(74) *Attorney, Agent, or Firm*—Christie, Parker & Hale, LLP

(57) ABSTRACT

A follower for holding a window pane is adjustable by a motor vehicle window lifter. The follower is connectable to the window lifter and has at least one retaining arm which can be brought into engagement with the window pane and thereby extends at least in part along a window pane surface. The follower is designed so that in the event of the window pane being loaded with force (F) in the lifting direction (H) a torque is exerted on the retaining arm of the follower. The torque is exerted in the direction of the window pane surface to press the retaining arm toward the window pane and prevent the window pane from becoming disengaged and sliding out from the follower.

17 Claims, 3 Drawing Sheets

FOLLOWER USING PIVOTING RETAINING ARMS FOR RETAINING A WINDOW PANE

CROSS-REFERENCE TO RELATED APPLICATION

This application claims priority of International application number PCT/DE99/02555, filed Aug. 13, 1999, which in turn claims priority to German patent application number 19840682.7, filed Aug. 26, 1998.

FIELD OF THE INVENTION

The invention relates to a follower for holding a window pane which can be adjusted by means of a vehicle window lifter.

BACKGROUND OF THE INVENTION

A follower of this kind is known from DE 4434589 A1. The known follower comprises a pair of elastically expanding jaws, which are connected to the base body of the follower. In order to insert a window pane into the follower the jaws are spread apart. After inserting the window pane the jaws move back to adjoin same; they thereby come into keyed engagement with a hole in the window pane or a positive locking element fixed on the window pane.

The drawback with the known follower is that if larger forces occur in the lifting direction of the window, for example in the event of a crash, the jaws of the follower are inclined to spread open. There is then the risk of the window pane coming out of the follower.

From EP 0 643 188 A1, a follower is known for a motor vehicle window lifter having a fixed part and a movable part fixed thereon. The movable part is fitted on the fixed part by swivelling the movable part about a swivel point of the fixed part and then sliding the movable part along the fixed part. This produces a positive and force-locking connection between the fixed and movable parts of the follower. The movable part has a retaining arm which adjoins a surface of the window pane which is to be taken up by the follower and engages with a projection through an opening in this window pane. In its functioning position (i.e. after fitting the movable part on the fixed part), this retaining arm is mounted so that when a removal force acts on the window pane having a tendency to loosen the window pane from the follower the retaining arm is swivelled in a direction away from the associated surface of the window pane.

From EP 0 694 669 A1 a device is known for connecting a window pane to a window lifter (follower) where a pair of clamping jaws are pressed in the region of a window pane edge through a tensioning force onto each one side of the window pane. The formation of this follower is such that the clamping jaws are inclined to spread out when a removal force acts on the window pane.

SUMMARY OF THE INVENTION

The object of the invention is therefore to provide a follower of the kind mentioned at the beginning which can also hold the window pane secure even when large forces arise in the lifting direction of same.

According to this, it is proposed to design the follower so that if the window pane is loaded with a removal force that has the tendency to loosen the window pane in the lifting direction out from the follower, a torque acts on the follower to press the at least one retaining arm of the follower, which is located in engagement with the window pane, in the direction of the window pane surface. This is possible in particular through a suitable design and binding of the retaining arm on the base body of the follower.

The invention is based on the surprising knowledge that securing the window pane from sliding out of the follower can be undertaken without any expensive additional structural elements by using the force which acts on the window pane and which threatens to loosen the pane, to strengthen the connection between the window pane and follower. This is based on the same underlying principle as in the case of scissors, where the cutters are closed when they hang down vertically by their handles.

The solution according to the invention has the advantage that as a result of the stressed design of the follower, the force by which the pane is held in the follower becomes greater the greater the force which acts on the window pane in the lifting direction. For it is the latter force which produces the torque through which the follower is pressed towards the surface of the window pane in order to strengthen the connection.

The window pane is therefore held securely in the follower up to very high removal forces. The limit lies only at those forces which would lead to a destruction of the follower.

In a preferred embodiment of the invention, the holding arm of the follower is able to swivel substantially across the plane of the window pane and can thereby be brought into positive locking engagement with the window pane.

The positive locking engagement can be produced in particular if the retaining arm has a stop which is supported on a counter surface of the window pane so that the window pane is prevented from sliding out from the follower in the lifting direction.

With this embodiment of the invention, the follower is designed so that the swivel movement of the retaining arm corresponds substantially to a movement about an imaginary swivel area which, as seen from the section of the retaining arm running along the window pane, is arranged behind a plane which runs through a force engagement point of the stop at the counter surface and parallel to the displacement plane of the window pane.

The swivel area can thereby be formed both by a conventional swivel axis and by a section of the follower with reduced material thickness.

It can thereby be proposed that the retaining arm has a connecting section which, as seen from the section of the retaining arm running along the window pane, is connected to the base body of the follower behind the aforementioned plane.

If the follower is provided in the conventional way for holding the window pane in the area of the lower pane edge then the connecting section of the retaining arm underneath the lower edge of the pane can be supported on the base body of the follower.

The retaining arm underneath the lower edge of the pane can thereby be supported on a counter member of the follower so that it can swivel about this counter member. Furthermore the retaining arm is preferably hung from the counter member of the follower secured against loss.

The stop at the upper end of the retaining arm of the follower is preferably formed as a hooked element which projects into an opening of the window pane associated with same or is supported on a counter face protruding from the window pane. This counter face can be formed on one side by a structural element which is pushed into an opening of the window pane or by a structural element which is stuck onto the window pane.

The follower can have on the side opposite the retaining arm a rigid follower section which adjoins the window pane. As an alternative, the follower can have two retaining arms which can be brought into engagement with opposing side faces of the window pane, wherein each retaining arm is formed so that when the window pane is loaded with a force in the lifting direction a torque is exerted on the retaining arm which presses it towards the surface of the pane.

In a preferred embodiment of the invention the two retaining arms of the follower criss-cross one another and thereby form a U-shaped socket for the lower edge of the pane.

The retaining arm itself is preferably made of an elastically deformable material and is connected for swivel or bending movement to the base body of the follower.

BRIEF DESCRIPTION OF THE DRAWINGS

Further advantages of the invention will be apparent from the following description of examples as shown in the drawings in which.

DETAILED DESCRIPTION OF THE INVENTION

Figure 1A:
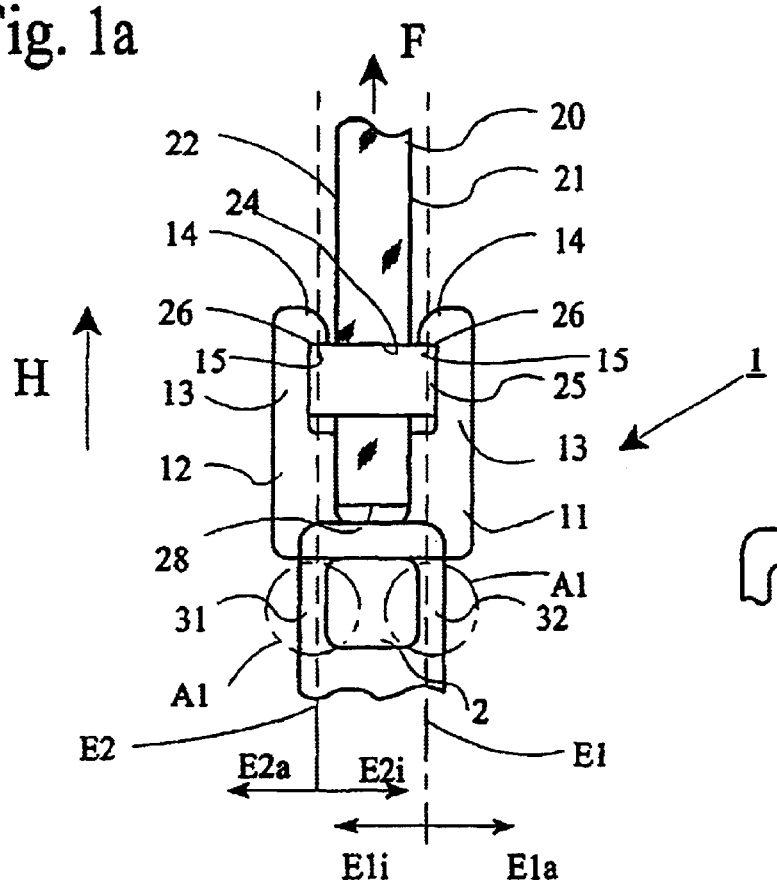
FIG. 1*a* is a side view showing a first embodiment of the follower according to the invention with two swivel retaining arms.

FIG. 1*a* shows a side view of a follower 1 in which a window pane 20 is inserted.

Figure 1B:
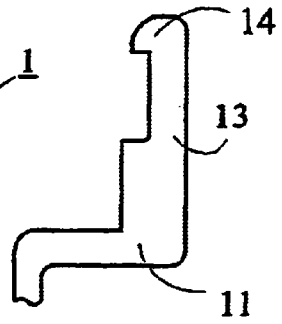
FIG. 1*b* is a view showing a retaining arm of the first embodiment shown on FIG. 1*a;*

The follower 1 comprises two retaining arms 11, 12 which are each connected to the base body 2 of the follower through a connecting section 31, 32. In addition, the retaining arm 11 is thereby shown separately in FIG. 1*b*.

The two retaining arms 11, 12 each have in their upper section 13 a hooked stop 14 which is supported on a counter face 26 of the window pane 20 running across the lifting direction H. The lifting face 26 is thereby formed by a bolt 25 which is inserted in an opening 24 of the window pane 20.

The two connecting areas 31, 32 through which the retaining arms 11, 12 are connected to the base member 2 of the follower 1 are characterised by a comparatively thin material thickness. The two connecting sections 31, 32 of the follower 1, which is preferably made of plastic, are therefore sufficiently elastic in order to form swivel areas A1 about which the retaining arms 11, 12 can be swivelled. Expressed in other terms, the retaining arms 11, 12 can be swivelled away from the associated window pane surface 21, 22 by elastically deforming the connecting sections 31, 32. This is necessary, for example, if the window pane 20 is inserted in the follower 1 against the lifting direction H.

This is only an imaginary swivel area A1 since there is no actual swivel movement of the retaining arms 11, 12 about an axis. Rather the elastic design of the retaining arms 11, 12 in their lower sections 31, 32 enables the retaining arms 11, 12 to bend corresponding substantially to a swivel movement of the retaining arms 11, 12 about the swivel area A1.

The particular feature in the design of the follower 1 is now that the swivel areas A1 are arranged so that a torque is exerted on the retaining arms 11,12 which presses them against the associated surface of the pane 21, 22 when a force F is exerted on the window pane 20 in the lifting direction H.

This is due to the fact that the connecting section 31, associated with the retaining arm 11, and the connecting section 32, associated with the retaining arm 12, each run—seen from the retaining arm 11 or 12—on the opposite side of the plane E1 or E2. The planes E1 and E2 respectively are defined in that they each run parallel to a surface 21 or 22 of the window pane through a force engagement point 15 in the vicinity of which the hooked stop 14 of the relevant follower 11 or 12 engages on the counter face 26 of the bolt 25 associated with same.

Expressed in other terms, the section of each retaining arm 11, 12 running from the stop 14 to the swivel area A1 extends at first substantially along the surface 21, 22 of the pane towards the lower edge 28 of the pane and then runs underneath the lower edge 28 of the pane across the window surface 21, 22 towards the associated swivel area A1 which is mounted on the side E1*i*, E2*i* of the corresponding plane E1, E2. The swivel area A1 is thus located not as is normal in the prior art, on the side E1*a*, E1*b* of the plane E1, E2 respectively, remote from the window pane 20.

The two retaining arms 11, 12 criss-cross underneath the lower edge 28 of the pane and thereby form above the intersection point a U-shaped section for the window pane 20 and underneath the intersection point swivel areas A1.

If a force F acts in the lifting direction H on the window pane 20 then this force is transferred in the region of the force engagement points 15 to the retaining arms 11 and 12 of the follower 1. As a result of the design of the follower described above, this results in a torque acting on the retaining arms 11 and 12 through which the retaining arms 11, 12 are moved towards each other substantially transversely to the window pane so that each retaining arm 11, 12 is pressed against the surface 21, 22 of the pane associated with same. This is based on the same principle that also causes scissors to fold up closed when hanging vertically down by their handles.

Thus the stronger the force F which acts on the window pane 20 in the lifting direction H then the greater is also the torque through which the retaining arms 11, 12 are pressed against the surfaces 21, 22 of the window pane. This has the result that the positive locking connection between the follower 1 and window pane 20 is strengthened through the retaining arms 11, 12 and the bolt 25.

It thus produces a 'self-tensioning' follower which uses the forces which could cause the window pane to become loose from the follower to strengthen the connection between the follower and window pane.

The window pane 20 can thereby also be held secured by the follower 1 even in the event of very strong loads in the lifting direction H (e.g. in the event of a crash).

Further embodiments of the invention that are based on the principle described above are illustrated in FIGS. 2 to 4.

With the description of these figures, only those features are dealt with in detail where the relevant embodiment differs from the example explained with reference to FIG. 1.

Figure 2A:
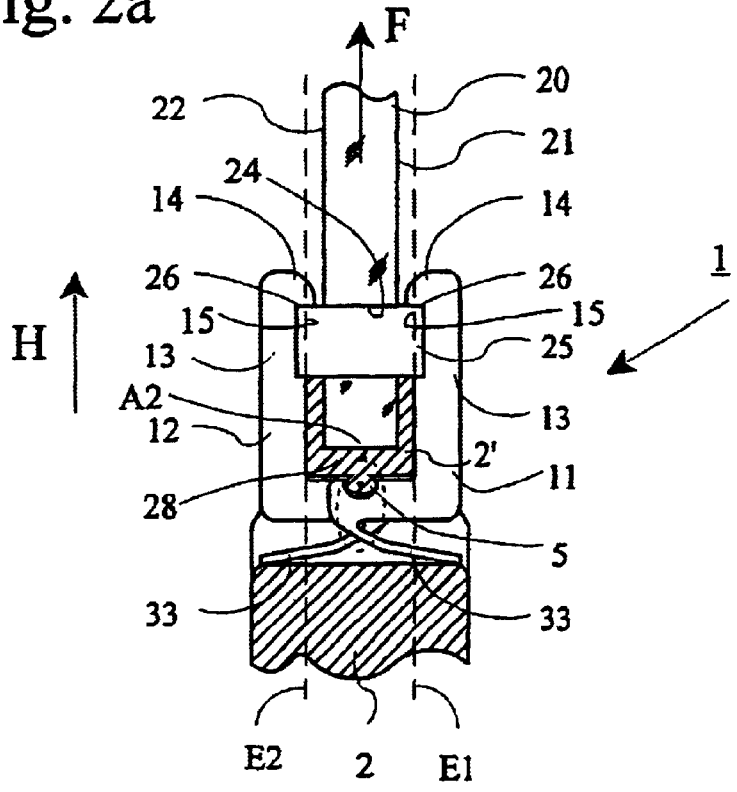
FIG. 2*a* is a side view showing a second embodiment of the follower according to the invention with two swivel retaining arms.

In FIG. 2*a* a follower 1 is shown in side view whose base body has a lower section 2 and an upper section 2'. The lower section 2 of the base body thereby serves to connect the follower to a window lifter whilst the upper section 2' of the base body surrounds the window pane 20 in the region of its lower edge 28.

Between the lower section 2 and the upper section 2' of the base body there is a recess into which a counter member 5 of the follower 1 projects. The counter member 5 has an undercut section and the two retaining arms 11, 12 of the follower 1 underneath the lower edge of the pane 28 are hung from this counter member 5.

Figure 2B:
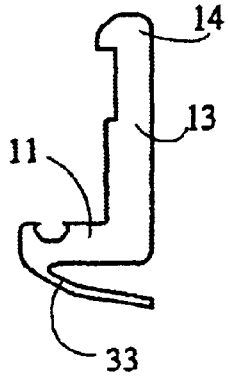
FIG. 2*b* is a side view showing the retaining arm of the second embodiment shown on FIG. 2*a;*

The retaining arm 11 is for clarity shown also separately in FIG. 2*b*.

The two retaining arms 11, 12 which criss cross underneath the lower edge 28 of the pane and the counter member 5 are formed spring-elastic in their lower sections 33 and are inserted under pretension into the recess between the upper section 2' and the lower section 2 of the base body of the follower 1.

The two retaining arms 11, 12 are therefore able to swivel about a swivel area A2 which is formed underneath the lower edge 28 of the pane in the vicinity of the counter member 5.

This is thereby a constructional swivel region wherein there is no actual swivel movement of the retaining arms 11, 12 about an ideal axis. Rather the elastic design of the retaining arms 11, 12 in their lower sections 33 enables bending of the retaining arms 11, 12 which corresponds substantially to a swivel movement of the retaining arms 11, 12 about the swivel area A2.

Even with this embodiment of the invention, the swivel area A2 is, seen from each retaining arm 11, 12, mounted behind the planes E1 and E2 respectively so that it produces a "self-tensioning follower" of the kind described in FIG. 1.

Figure 3:
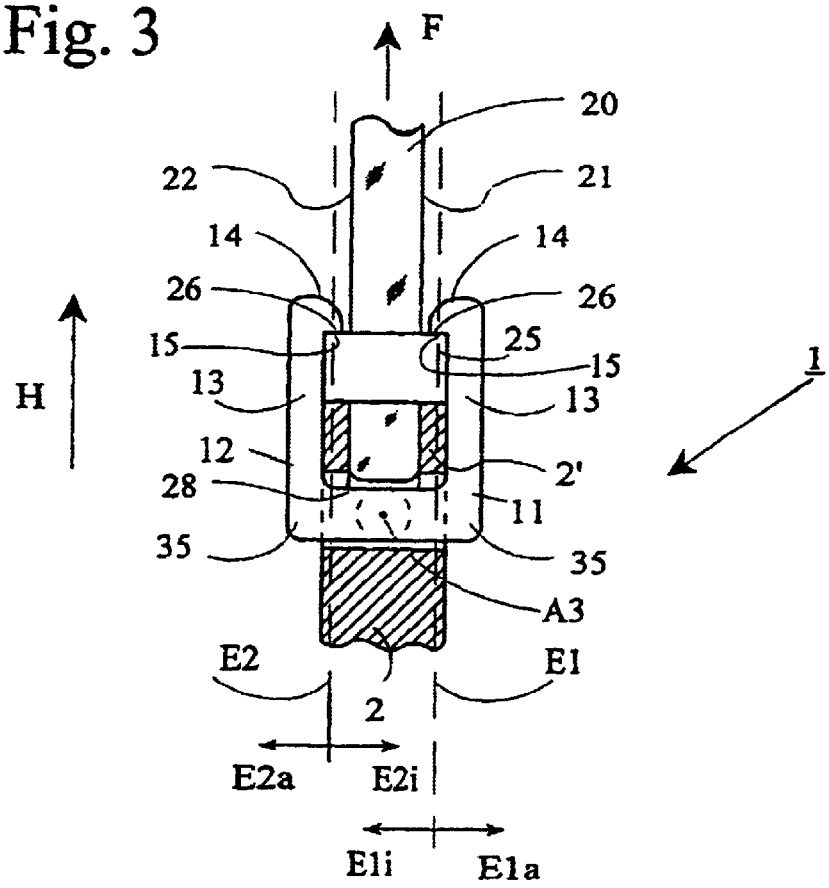
FIG. 3 shows a third embodiment of the follower according to the invention with two swivel retaining arms.

Also, with the embodiment of the invention illustrated in FIG. 3, the base body of the follower has a lower section 2 and an upper section 2' which are separated from each other through a recess.

In this recess there is a bearing point underneath the lower edge 28 of the pane to form a swivel axis A3 for the retaining arm 11, 12 of the follower 1.

With this embodiment of the invention, the design of the retaining arms 11, 12 comes closest to scissors insofar as these are able to swivel about an actual axis A3 to which they are attached by their lower sections 35.

Also with this embodiment of a follower 1 according to the invention, a force F acts in the lifting direction H of the window pane which engages through the force engagement points 15 on the retaining arms 11, 12 of the follower 1 so that the two retaining arms 11, 21 move towards each other. The positive locking engagement between the follower 1 and the window pane 20 is thereby strengthened through the retaining arms 11, 12 and the bolt 25.

Figure 4:
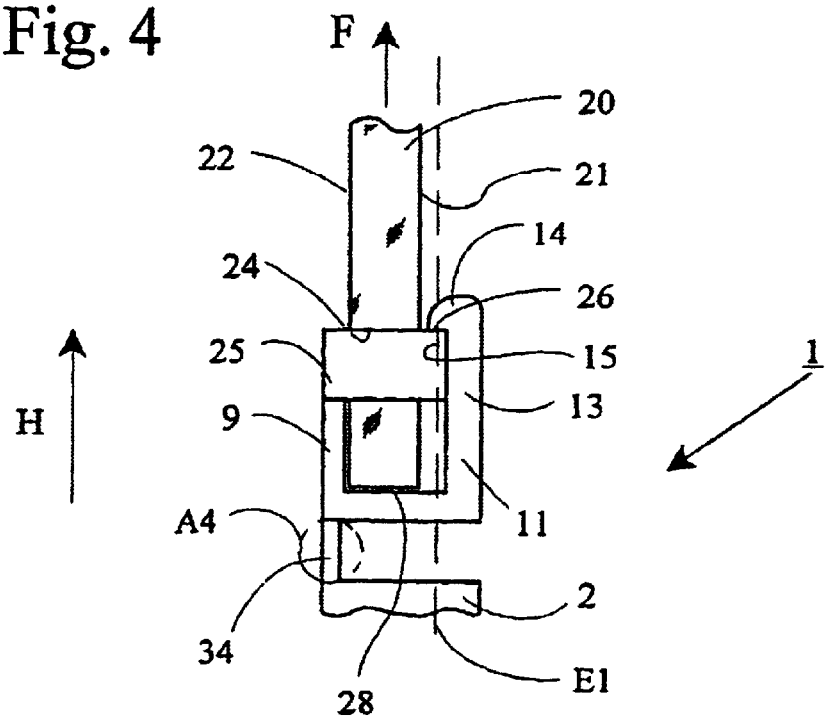
FIG. 4 shows an embodiment of the follower according to the invention with only one swivel retaining arm.

The follower 1 illustrated in FIG. 4 differs from the embodiments of the invention described up until now in that it only has one swivel retaining arm 11.

The upper section 13 of the retaining arm 11 has a hooked stop 14 which is supported on a counter face 26 of the window pane 20 which is formed by a bolt 25.

The retaining arm 11 is connected underneath the lower edge 28 of the pane through a connecting section 34 of thinner material thickness to the base body 2 of the follower 1. This connecting section 34 forms a swivel area A4 which is mounted on the opposite side of the window pane 20 seen from the retaining arm 11. Thus the retaining arm 11 of the present embodiment has the same structure as the retaining arm 11 illustrated in FIG. 1.

Moreover in the embodiment according to FIG. 4 the retaining arm 11 is not associated with any second retaining arm on the opposite side of the window pane 20. Rather a rigid follower section 9 extends there where it adjoins the side 22 of the window pane remote from the retaining arm 11.

Figure 5:
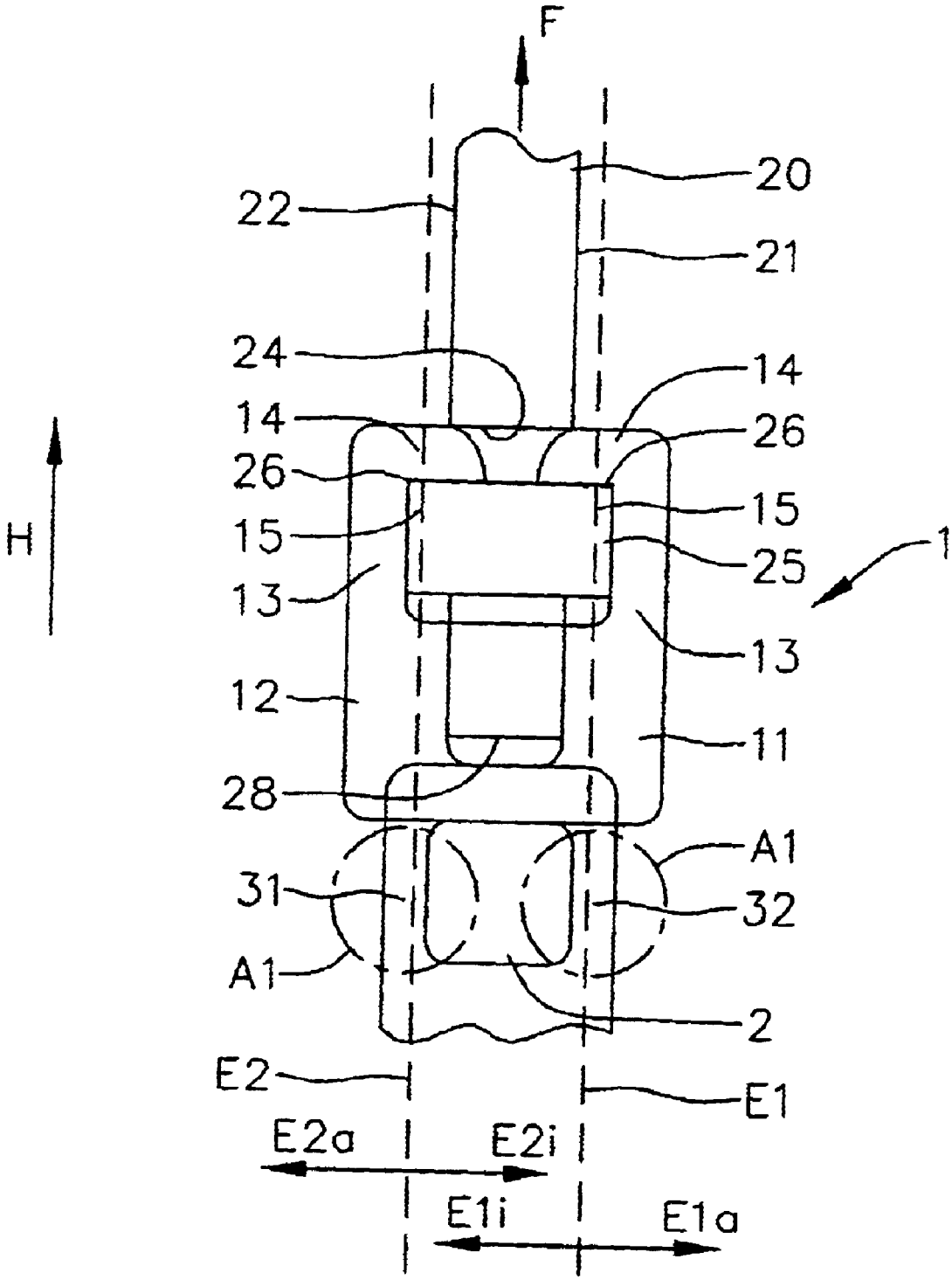
FIG. 5 shows an embodiment of the follower according to the invention wherein the stops extend into an opening of the window pane.

With the present embodiment, only one retaining arm 11 is provided which, when the window pane 20 is loaded with a force F in the lifting direction H, is moved towards the pane surface 21 associated therewith and ensures a secure positive locking engagement between the follower 1 and the window pane 20 through the hooked stop 14 and the bolt 25. The rigid follower section 9 thereby only serves as an abutment. FIG. 5 illustrates another exemplary embodiment in which stops 14 extend into opening 24 of the window pane 20.

In short all the embodiments of the invention described above are characterised in that when the window pane is loaded with a force F in the lifting direction H, a torque acts on at least one retaining arm of the follower which counteracts the window pane slipping out from the follower.

What is claimed is:

1. A follower for holding a window pane and connectable to a window lifter, the follower comprising:

a pair of retaining arms disposed on opposite sides of the window pane, each of the opposite sides of the window pane having a corresponding window pane surface, each retaining arm including a stop and engageable with one of the window pane and a structural element connected to the window pane and thereby extending at least in part along a respective one of the window pane surfaces;

at least one of a pivot area and a pivot axis corresponding to each retaining arm such that when the window pane is loaded with a removal force as a result of which the window pane has a tendency to slide out from the follower in a lifting direction, each retaining arm pivots about said one of a pivot area and a pivot axis such that the retaining arm exerts a force toward the respective window pane surface; and a pair of counter faces associated with the window pane wherein each stop acts in conjunction with an associated one of said counter faces to thereby prevent the window pane from sliding out of the follower in the lifting direction;

wherein, for each retaining arm, the retaining arm is disposed along one side of a plane formed by the respective one of the window pane surfaces, and the corresponding at least one of a pivot area and a pivot axis is disposed on the opposite of the plane.

2. A follower according to claim 1, wherein each retaining arm further includes a section that extends underneath a lower edge of the window pane and a component of the section runs transversely to the respective one of the window pane surfaces towards the corresponding one of a pivot area and a pivot axis.

3. A follower according to claim 2, wherein, each pivot area is formed by a section of the follower having a material thickness that is less than a corresponding material thickness of the corresponding retaining arm.

4. A follower according to claim 3, further comprising:

a connecting section associated with each retaining arm; and a base body;

wherein each connecting section is coupled to the base body underneath the lower edge of the window pane.

5. A follower according to claim 2, wherein each stop projects into an opening of the window pane.

6. A follower according to claim 2, further comprising:

connecting sections associated with said retaining arms; and a base body, each connecting section connecting the base body to the respective retaining arm;

wherein, for each retaining arms, the associated connecting section is connected to the base body on the opposite side of the plane formed by the first window pane surface.

7. A follower according to claim 1, wherein both said retaining arms pivot about a counter member disposed beneath a lower edge of the window pane.

8. A follower according to claim 7, wherein each retaining arm underneath the lower edge of the window pane includes a lower section engaged with the counter member.

9. A follower according to claim 1, wherein each retaining arm pivots substantially transversely to the respective one of the window pane surfaces.

10. A follower according to claim 1, wherein each counter face protrudes from the window pane.

11. A follower according to claim 10, wherein the window pane is disposed along a first planar direction, each stop includes an orthogonal component extending in a direction orthogonal to the first planar direction, and each counter face contacts a corresponding one of the orthogonal components such that each counter face is thereby prevented from moving past the corresponding stop in the lifting direction.

12. A follower according to claim 1, wherein the follower can be brought into locking engagement with the window pane.

13. A follower according to claim 1, wherein the two retaining arms crisscross underneath a lower edge of the window pane.

14. A follower according to claim 1, wherein the pair of retaining arms form a substantially U-shaped socket for an edge of the window pane.

15. A follower according to claim 1, wherein at least one of the retaining arms is formed of an elastically deformable material.

16. A follower according to claim 1, further comprising a base body, wherein each retaining arm is connected to the base body.

17. A follower for holding a window pane and connectable to a window lifter, the follower comprising:

a retaining arm disposed on a side of the window pane having a first window pane surface, the retaining arm including a stop engageable with a structural element extending through an opening in the window pane, the retaining arm extending at least in part along the first window pane surface;

a pivot area corresponding to the retaining arm such that when the window pane is loaded with a removal force, as a result of which the window pane has a tendency to slide out from the follower in a lifting direction, the retaining arm pivots about the pivot area such that the retaining arm exerts a force toward the first window pane surface;

a rigid follower section coupled to the retaining arm and adjoining a second window pane surface opposite the retaining arm; and the structural element including a counter face wherein the stop acts in conjunction with the counter face to thereby prevent the window pane from sliding out of the follower in the lifting direction;

wherein the retaining arm is disposed along one side of a plane formed by the first window pane surface, and the pivot area is disposed on the opposite side of the plane.

* * * * *

UNITED STATES PATENT AND TRADEMARK OFFICE

CERTIFICATE OF CORRECTION

PATENT NO. : 6,651,388 B1
DATED : November 25, 2003
INVENTOR(S) : Scheck

It is certified that error appears in the above-identified patent and that said Letters Patent is hereby corrected as shown below:

Column 6,
Line 64, delete "," after "wherein"

Column 7,
Line 2, delete "a connecting section associated with each retaining arm;", insert -- connecting sections associated with said retaining arms; --
Line 10, delete "connecting sections associated with said retaining arms;", insert -- connecting sections each associated with a respective one of said retaining arms; --
Lines 16 and 17, delete "opposite side of the plane formed by the first window pane surface", insert -- opposite side of the plane formed by the respective one of the window pane surfaces --

Signed and Sealed this

Seventh Day of June, 2005

JON W. DUDAS
*Director of the United States Patent and Trademark Office*